US007679589B2

(12) United States Patent
Park

(10) Patent No.: US 7,679,589 B2
(45) **Date of Patent: *Mar. 16, 2010**

(54) LIQUID CRYSTAL DISPLAY DEVICE

(75) Inventor: Chul-Woo Park, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1106 days.

This patent is subject to a terminal disclaimer.

(21) Appl. No.: 11/326,692

(22) Filed: Jan. 6, 2006

(65) Prior Publication Data

US 2006/0164369 A1 Jul. 27, 2006

(30) Foreign Application Priority Data

Jan. 24, 2005 (KR) ..... 10-2005-0006399

(51) Int. Cl.
*G09G 3/36* (2006.01)

(52) U.S. Cl. ..... 345/87; 345/98; 345/102

(58) Field of Classification Search ..... 345/38–39, 345/48, 50–55, 83–84, 87–100, 102, 204–205, 345/208–211, 214
See application file for complete search history.

(56) References Cited

U.S. PATENT DOCUMENTS 7,522,143 B2 * 4/2009 Park et al. ..... 345/98

FOREIGN PATENT DOCUMENTS

| | | |
|---|---|---|
| JP | 63-058322 | 3/1988 |
| JP | 02-055280 | 4/1990 |
| JP | 04-177391 | 6/1992 |
| JP | 05-328269 | 12/1993 |
| JP | 06-222360 | 8/1994 |
| JP | 2001-059957 | 3/2001 |
| JP | 2002-303849 | 10/2002 |
| JP | 2002-366124 | 12/2002 |
| JP | 2003-222906 | 8/2003 |
| JP | 2003-270669 | 9/2003 |
| JP | 2003-279928 | 10/2003 |
| JP | 2004-004659 | 1/2004 |

OTHER PUBLICATIONS

Japanese Office action dated Oct. 28, 2008, for corresponding Japanese Application 2005-134629, noting reference listed in this IDS.
Office Action for corresponding Korean Patent Application No. 10-2005-0006399 dated Sep. 28, 2006.
*LM555 Timer*, 2000 National Semiconductor Corporation DS007851; www.national.com.

* cited by examiner

*Primary Examiner*—Richard Hjerpe
*Assistant Examiner*—Mansour M Said
(74) *Attorney, Agent, or Firm*—Christie, Parker & Hale, LLP

(57) ABSTRACT

The present invention relates to a liquid crystal display device with a source driver in which a significant signal delay is not generated, and which has a fast response speed. The present invention also provides a liquid crystal display device comprising a scan driver including a D/A converter for outputting analog signals corresponding to gradation data input, a triangular wave generator for outputting triangular wave signals, and a comparator for applying data voltage to each pixel which include OCB liquid crystal cells by comparing the analog signals with the triangular wave signals. The data voltage is a PWM pulse with a varied voltage width.

12 Claims, 5 Drawing Sheets

WHEN PULSE IS AT THE CENTER

WHEN PULSE IS AT THE LEFT SIDE

WHEN PULSE IS AT THE RIGHT SIDE

LIQUID CRYSTAL DISPLAY DEVICE

CROSS REFERENCE TO RELATED APPLICATIONS

This application claims priority to and the benefit of Korean Patent Application No. 10-2005-0006399, filed on Jan. 24, 2005, the disclosure of which is incorporated herein by reference in its entirety.

BACKGROUND OF THE INVENTION

1. Field of the invention

The present invention relates to a liquid crystal display device. Specifically, to a liquid crystal display device with a source driver in which a significant signal delay is not generated, and which has a fast response speed.

2. Description of Related Art

Recently, weight reduction and shape thinning of display devices have been required to conform to the weight reduction and shape thinning of personnel computers, televisions, etc. Therefore, flat panel displays such as liquid crystal display (LCD) devices are being developed to meet these requirements, instead of cathode ray tubes(CRTs).

LCDs are display devices for obtaining a desired image signal by applying an electric field to liquid crystals having an anisotropic dielectric constant placed (i.e., injected) between two substrates and controlling electric field intensity, thereby controlling an amount of light transmitted onto the substrates from an external light source(backlight).

Generally, LCD devices have already widely been used as screen display devices for portable information appliances such as cellular phones, computers and personal digital assistants (PDAs), because they are thinner, lighter and consume less electric power compared with CRTs. Further, LCD devices are commonly used in certain fields, because fewer electromagnetic waves are emitted from the LCD devices than from CRTs.

LCD devices are typically used as display devices in portable flat panel displays, and a thin film transistor-liquid crystal display (TFT-LCD), in which a thin film transistor is used as a switching device, is commonly used in LCD devices.

Generally, LCD devices are categorized according to the method of displaying color images into color filter type LCD devices and field sequential driving type LCD devices.

The color filter type LCD devices display desired images by forming a color filter layer including of three primary colors of red (R), green (G) and blue (B) on one of two substrates and controlling an amount of light transmitted onto the color filter layer. The color filter type LCD device displays desired images by controlling an amount of light transmitted onto the R, G and B color filter layers, thereby combining R, G and B colors when transmitting light irradiated from a single light source onto R, G and B color filter layers.

In an LCD device for displaying images by using the single light source and the three color filter layers, the LCD device requires three times as many pixels as an LCD device for displaying images by using black and white colors because each display point in the device is composed of three unit pixels corresponding to R, G and B regions. Therefore, a technology for delicately fabricating these complex LCD panels is required to obtain images of high resolution. Further, it is inconvenient to fabricate the LCD device, because each color filter layer should be formed on a separate substrate, and consequently the luminance of the LCD device is reduced, because light transmittance of each color filter is low.

The field sequential driving type LCD device obtains full color images by lighting independent light sources of R, G and B colors sequentially and periodically and applying corresponding color signals to respective pixel and synchronizing the lighting cycles of the light sources. Specifically, the field sequential driving type LCD device displays images by sequentially time-share displaying lights of three primary colors of R, G and B that are outputted from R, G and B backlights onto one pixel where the one pixel is not divided into R, G and B unit pixels, thereby creating a persistent image for the eyes.

The field sequential driving type LCD devices are further divided into analog driving type LCD devices and digital driving type LCD devices. The analog driving type LCD device displays gradation in a transmission at a level that corresponds to the gradation voltage applied. This is done by setting a plurality of gradation voltages corresponding to the number of gradations to be displayed and selecting one gradation voltage corresponding to gradation data from the gradation voltages so that a liquid crystal panel is driven by the selected gradation voltage.

On the other hand, the digital driving type LCD device displays a gradation by constantly applying a driving voltage to liquid crystals and controlling an applying time of the driving voltage. According to the digital driving type LCD device, a gradation is displayed by constantly maintaining a driving voltage and timely controlling the voltage applying state and the voltage non-applying state, thereby controlling an amount of light that is transmitted through the liquid crystals.

LCD devices have a drawback of having a narrow viewing angle since light, darkness and color tone change according to the screen viewing direction. Various methods for overcoming this drawback have been suggested.

For example, in order to improve the viewing angle of an LCD device, a method for improving the vertical luminance as much as 30% or more by attaching a prism film to the surface of a light guide plate may be used, thereby improving the straightness of incident light from the backlight of the LCD device. A method for increasing the viewing angle by attaching a negative light compensation plate to the surface of the light guide plate may also be used.

Further, although the in-plane switching mode provides vertical and horizontal viewing angles of 160 degrees which is a wide viewing angle that is almost on the same level with cathode-ray tubes, an improved countermeasure for a lower opening ratio is necessary since the in-plane switching mode has a relatively low opening ratio.

Additionally, many techniques for improving viewing angle of the LCD devices concentrate on providing optically compensated bend (OCB) mode LCD devices, polymer dispersed liquid crystal (PDLC) mode LCD devices and deformed helix ferroelectric (DHF) mode LCD devices using thin film transistors (TFTs). Particularly, the OCB mode LCD devices are currently actively being studied due their benefits of fast response speed and wide viewing angle of liquid crystals.

FIG. 1 is a liquid crystal state diagram for explaining the operation of an ordinary OCB mode LCD device.

Referring to FIG. 1, the initial alignment state of liquid crystals positioned between an upper plate electrode and a lower plate electrode is the homogeneous state, and when a certain voltage is applied to the upper and lower plate electrodes, the liquid crystals operate in an OCB mode after the homogeneous state is converted into the bend state through transient splay and asymmetric splay.

As illustrated in FIG. 1, formed OCB mode liquid crystal cells generally have about 10 to 20 degrees of tilt angle and 4 to 7 μm of thickness, and an alignment film of the liquid crystal cells is rubbed in the same direction. A high voltage is applied to the liquid crystal molecules to form the tilt angle of the liquid crystal molecules at 90 degrees in the center of the liquid crystal layer. A voltage to be applied to the liquid crystal molecules is varied to modulate polarization of light passing through the liquid crystal layer by changing the tilt of the rest of the liquid crystal molecules except the alignment film and the liquid crystal molecules in the center of the liquid crystal layer since the alignment of liquid crystal molecules in the center of the liquid crystal layer is horizontally symmetrical so that a tilt angle of the liquid crystal molecules at a specific voltage or less is zero degrees, and the tilt angle of the liquid crystal molecules at a specific voltage or more is 90 degrees. It generally takes several seconds to arrange the liquid crystal molecules of a central portion of the liquid crystal layer to have a tilt angle of 0 to 90 degrees. A reaction time of the liquid crystal molecules is very fast at about 10 μs since the arrangement is a bending deformation having a highly elastic coefficient without back-flow.

The above described conventional LCD device includes an LCD panel equipped with a plurality of pixels, a source driver, a scan driver and a backlight for driving the LCD panel. Therefore, scan signals are sequentially applied from the scan driver, and a data voltage is synchronized with the scan signals to be applied from the source driver to corresponding pixels so that the transmittance of liquid crystals is changed according to the applied voltage, wherein a light is cast on the LCD panel from the backlight so that a screen image is displayed by emitting the light in a luminance corresponding to the transmittance of the liquid crystals.

FIG. 2 is a block diagram illustrating a source driver of the conventional LCD device. Referring to FIG. 2, a source driver 20 of a conventional LCD device includes a digital to analog converter 21 and an amp/buffer 22. The digital to analog converter 21 outputs the converted voltage value by receiving gradation data for red R, green G and blue B that corresponds to screen display data and converting the gradation data into an analog voltage value. The amp/buffer 22 amplifies the analog voltage value so that the amplified analog voltage value is output to an LCD panel 10.

However, a slew rate is limited in the above mentioned source driver 20 of the conventional LCD device due to technical limitations of the output of the operational amplifier included in the amp/buffer 22. That is, the output of the amp/buffer 22 is amplified with a time delay compared with an expected voltage value corresponding to the analog voltage value that is the input of the amp/buffer 22. Since this phenomenon limits frame frequency of an OCB mode LCD device, the conventional LCD device has a problem that the benefit of fast response speed possessed by the OCB mode LCD device is not sufficiently exhibited.

SUMMARY OF THE INVENTION

Therefore, in order to solve the foregoing problem of the prior art, it is a feature of the present invention to provide an LCD device including a newly structured source driver for generating a pulse width modulation(PWM) type output signal to an LCD panel.

In order to achieve the foregoing feature, the present invention provides an LCD device including an LCD panel that includes a plurality of pixels which are formed in a region where a plurality of scan lines and a plurality of data lines cross each other and include OCB liquid crystal cells including a common electrode, a pixel electrode and OCB liquid crystals; a scan driver for applying a scan signal for selecting the plurality of pixels through the plurality of scan lines; a source driver for applying data voltages to the plurality of pixels through the plurality of data lines; a backlight part for applying a light source to the LCD panel; a backlight controller for applying a backlight voltage to the backlight part; and a timing controller for applying control signals for controlling operation of the scan driver, the source driver and the backlight controller, wherein the source driver includes a D/A converter for outputting analog signals corresponding to gradation data input, a triangular wave generator for outputting triangular wave signals, and a comparator for generating the data voltages by comparing the analog signals with the triangular wave signals.

BRIEF DESCRIPTION OF THE DRAWINGS

The above and other features of the present invention will become more apparent to those of ordinary skill in the art by describing in detail exemplary embodiments thereof with reference to the attached drawings in which.

DETAILED DESCRIPTION

Figure 1:
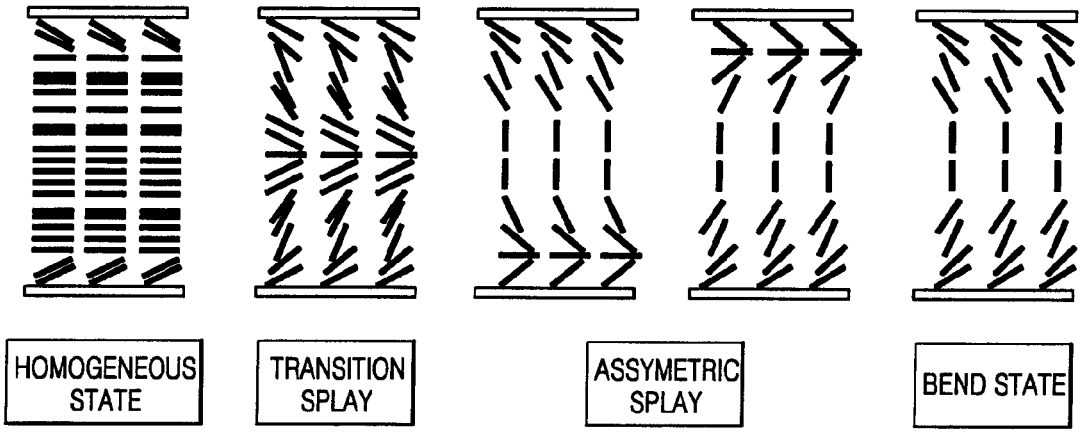
FIG. 1 (PRIOR ART)
FIG. 1 is a liquid crystal state diagram for explaining the operation of an ordinary OCB mode LCD device.

The present invention will now be described in detail in connection with certain exemplary embodiments with reference to the accompanying drawings. In the drawings, like reference characters designate like elements throughout several views.

Figure 3:
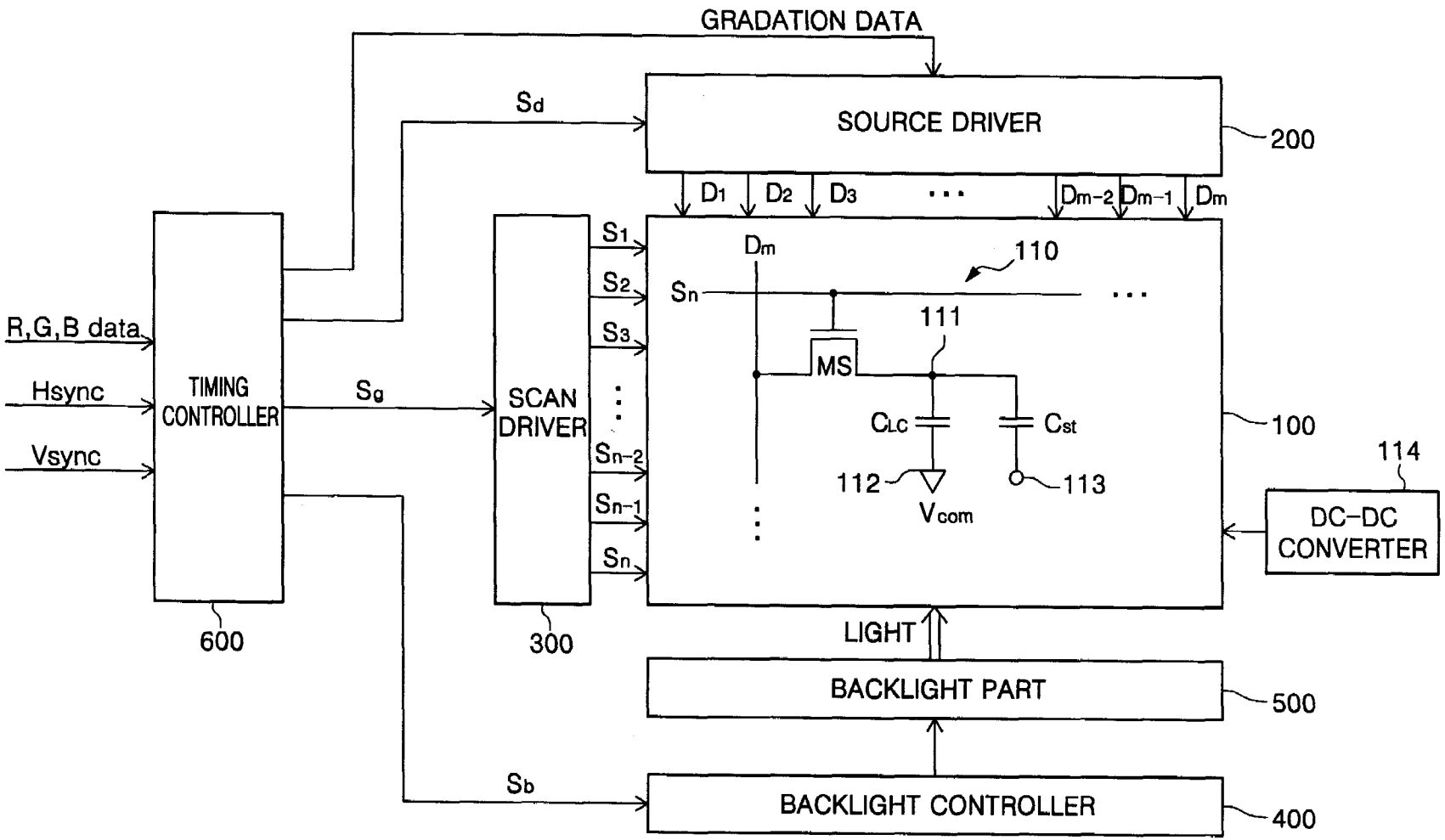
FIG. 3 is a block diagram illustrating an LCD device according to exemplary embodiments of the present invention.

FIG. 3 is a block diagram illustrating an LCD device according to exemplary embodiments of the present invention.

Referring to FIG. 3, the LCD device according to exemplary embodiments of the present invention includes an LCD panel 100, a source driver 200, a scan driver 300, a backlight controller 400, a backlight part 500 and a timing controller 600.

The LCD panel 100 includes a plurality of pixels 110 formed on a region wherein a plurality of scan lines S1-Sn and a plurality of data lines D1-Dm cross each other so that a screen image is displayed. In FIG. 3, a pixel 110 connected to an n th scan line Sn and an m th data line Dm in N×M units of pixels is depicted as a part of the LCD panel 100. Each of the pixels 110 includes switching transistor MS, OCB liquid crystal cell $C_{LC}$ and storage capacitor $C_{ST}$.

A source terminal of the switching transistor MS is connected to the data line Dm, and a gate terminal of the switching transistor MS is connected to the scan line Sn. The switching transistor MS is switched on by a scan signal applied through the scan line Sn and transmits a data voltage applied through the data line Dm to the OCB liquid crystal cell $C_{LC}$.

The OCB liquid crystal cell $C_{LC}$ includes a pixel electrode 111, a common electrode 112 and an OCB liquid crystal layer between the pixel electrode 111 and the common electrode 112. The pixel electrode 111 is connected to a drain terminal of the switching transistor MS such that the data voltage transmitted through the data line Dm is applied to the pixel electrode 111. A common voltage Vcom is applied to the common electrode 112 that is an electrode oppositely disposed to the pixel electrode 111. A voltage difference between a voltage applied pixel electrode 111 and a voltage applied common electrode 112 changes the alignment state of OCB liquid crystal molecules so that a transmittance varies according to the polarization state of light passing through the OCB liquid crystal layer.

The storage capacitor CST includes a pixel electrode 111, a storage electrode 113 and an insulation layer (e.g., a dielectric layer) between the pixel electrode 111 and the storage electrode 113, wherein the storage electrode 113 is connected to the common electrode 112 of the OCB liquid crystal cell $C_{LC}$. Therefore, the storage capacitor $C_{ST}$ is connected to the OCB liquid crystal cell $C_{LC}$ in parallel and plays a role of storing an electric charge corresponding to a voltage difference between the data voltage and a common voltage inputted into the common electrode for a certain period of time.

The scan driver 300 sequentially applies scan signals through a plurality of scan lines S1-Sn, and the source driver 200 sequentially applies a plurality of pulse waveforms to corresponding pixels through a plurality of data lines D1-Dm to display an LCD panel 100. A structure in which the produced plurality of pulse waveforms are sequentially applied to corresponding pixels by producing a plurality of pulse waveforms in the source driver 200 is discussed at greater length below.

The timing controller 600 outputs gradation data and control signal Sd to the source driver 200 and outputs a control signal Sg for controlling the scan driver 300 to the scan driver 300 after receiving R, G, B data, a horizontal synchronization signal Hsync and a vertical synchronization signal Vsync from an outer image processing part that is not illustrated. Further, the timing controller 600 transmits a light source control signal Sb to a backlight controller 400 such that a backlight part 500 outputs a light to the LCD panel 100.

The backlight controller 400 applies a certain voltage for driving the backlight part 500 disposed on the rear surface of the LCD panel 100 to the backlight part 500 according to a backlight control signal Sb applied from the timing controller 600. The backlight part 500 may include red, green and blue LEDs for sequentially outputting red, green and blue lights in the case of a field-sequential driving type, and the backlight part 500 can be a white LED or cold cathode fluorescence lamp for outputting white light in the case of a driving type using color filters. Further, red, green and blue color filters are formed on a common electrode per each unit pixel in case of an LCD device of the driving type using color filters.

Further, a high voltage (for example, about 15V to 30V) is applied to a common electrode 112 in the liquid crystal cells $C_{LC}$ to transition OCB liquid crystals in the LCD device from the bend state to an initial state. The LCD device further includes a DC-DC converter 114 (illustrated in FIG. 3) for applying the high voltage to the common electrode 112.

Figure 2:
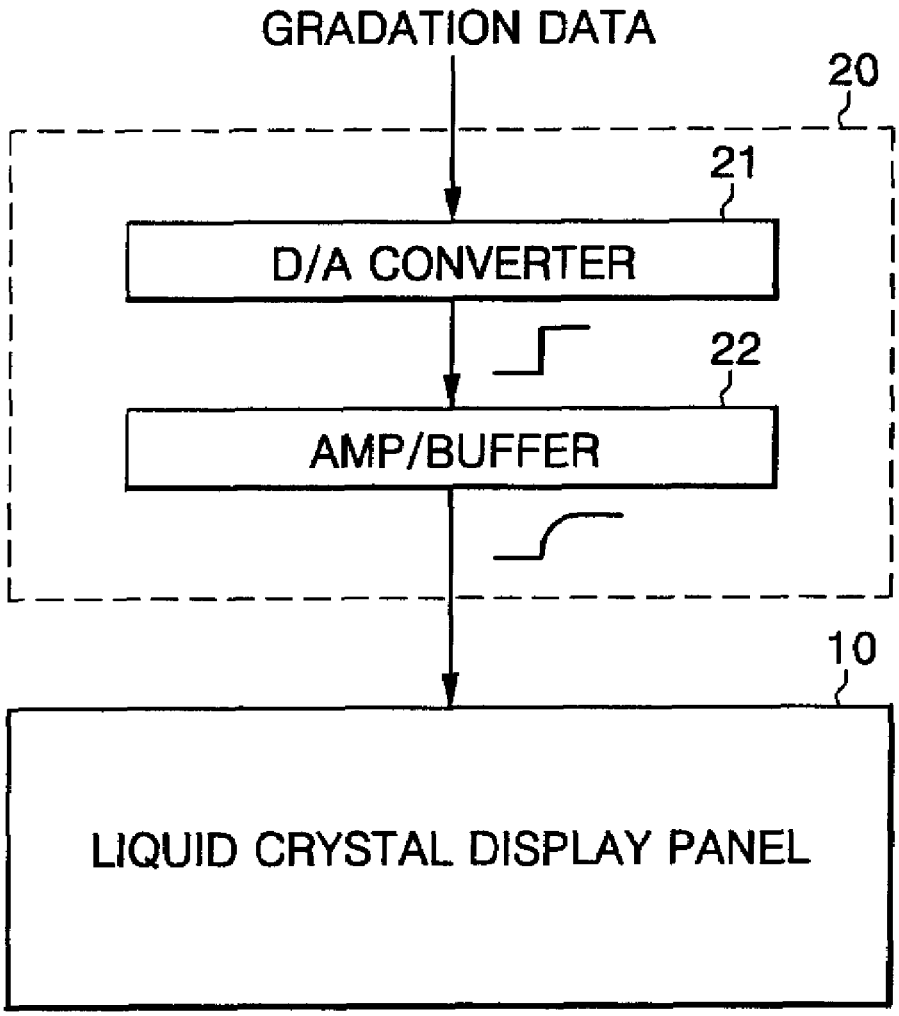
FIG. 2 (PRIOR ART)
FIG. 2 is a block diagram illustrating a source driver of a conventional LCD device.

A conventional source driver outputs analog voltage to be applied to each pixel by using a D/A converter 21 and an amp/buffer 22 (See FIG. 2, for example). However, because an LCD device in the exemplary embodiments of the present invention applies the analog voltage to each pixel by using a source driver 200 to output a PWM type pulse, the LCD device thereby accelerates the response speed to obtain the benefits of OCB mode without using an amp that causes a conventional signal delay problem due to the limit of slew rate. The source driver of the LCD device according to exemplary embodiments of the present invention and a method for driving the source driver are described in greater detail in reference to FIG. 4 and FIGS. 5A-5C.

Figure 4:
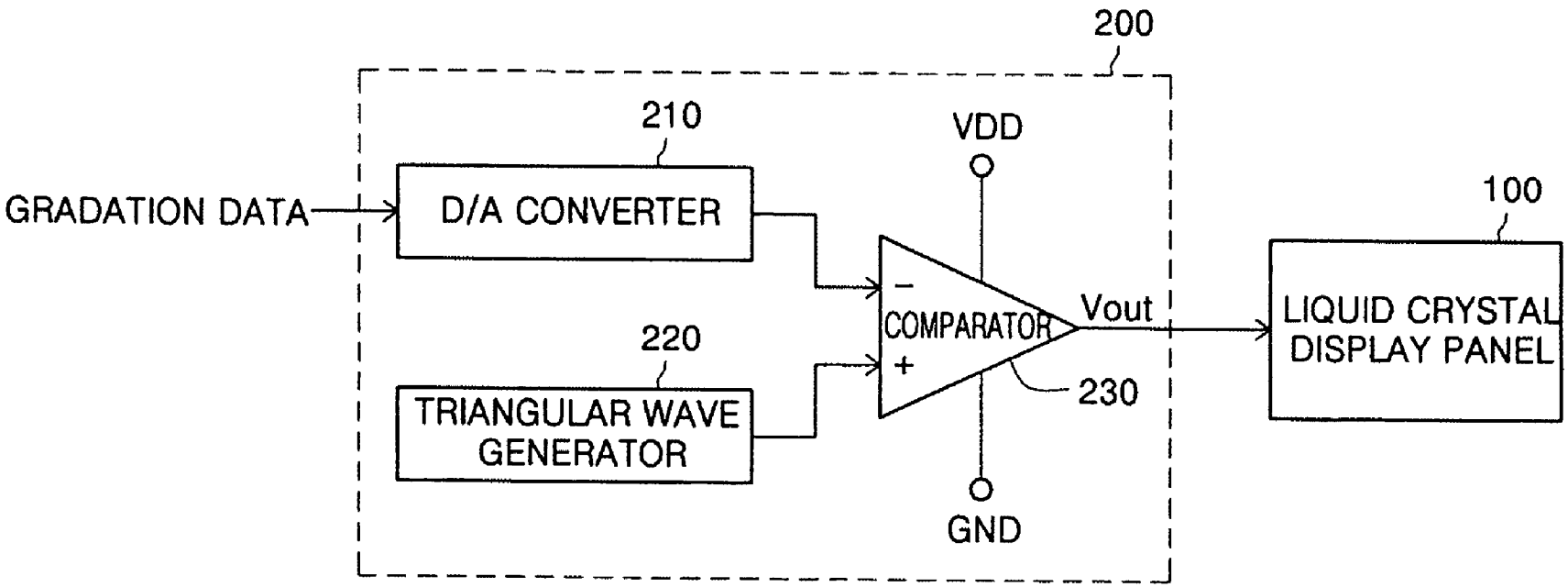
FIG. 4 is a block diagram illustrating a source driver of an LCD device according to exemplary embodiments of the present invention.

FIG. 4 is a block diagram illustrating a source driver of an LCD device according to exemplary embodiments of the present invention.

Referring to FIG. 4, the source driver 200 of an LCD device according to exemplary embodiments of the present invention includes a D/A converter 210, a triangular wave generator 220 and a comparator 230.

The D/A converter 210 outputs an analog voltage based on received gradation data, which are digital signals output by the timing controller 600.

The triangular wave generator 220 produces and outputs variously shaped triangular waves. The triangular waves are generally produced either by a function generator or by a square wave generator (that is not illustrated on drawings) for generating square waves in combination with an integrator (that is not illustrated on drawings) for integrating the square waves.

The comparator 230 includes a negative input terminal(−) into which an analog signal output from the D/A converter 210 is input, a positive input terminal(+) into which a triangular wave output from the triangular wave generator 220 is input, an output terminal Vout, and a driving voltage terminal for driving the comparator 230. Therefore, the comparator 230 compares the voltage of an analog signal output from the D/A converter 210 with a voltage of a triangular wave signal output from the triangular wave generator 220 during one frame. The comparator 230 outputs a driving voltage VDD if the triangular wave signal is greater than the analog signal and outputs a driving signal GND if the triangular wave signal is less than the analog signal. Therefore, a pulse signal having various pulse widths can be output according to the voltage amplitude of the analog signal, using a power supply that is directly applied from the outside. Because only one driving power supply VDD is used to drive the output signal at a constant voltage, it is not necessary to use an operational amplifier (AMP).

This PWM signal may be applied to each pixel 110 of the LCD panel 100 and charged into the storage capacitor $C_{ST}$ in such a way that the PWM signal is charged at a voltage proportional to the width of the applied pulse. Various gradations can be displayed by varying the width of a pulse signal, thereby changing the alignment state of liquid crystals. The operation of a source driver 200 having the foregoing structure is described in greater detail in reference to FIGS. 5A-5C.

Figure 5A:
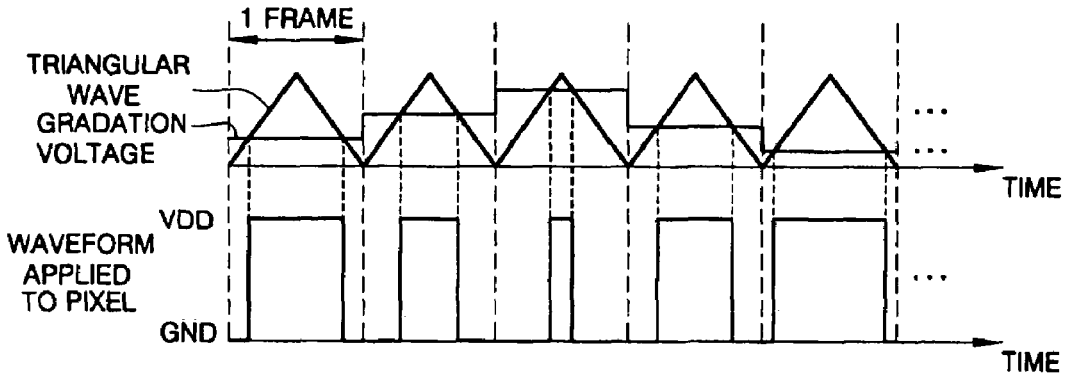
FIG. 5A is a waveform diagram illustrating a driving method for a source driver of an LCD device according to exemplary embodiments of the present invention, where a centered pulse is generated.
Figure 5B:
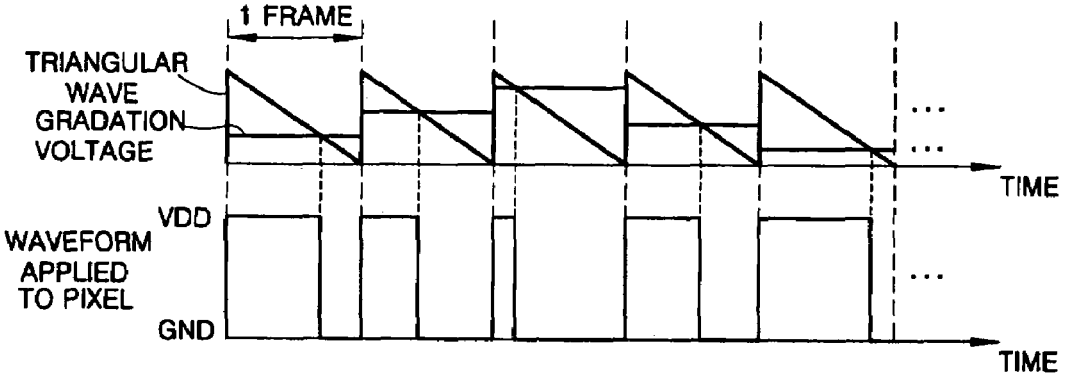
FIG. 5B is a waveform diagram illustrating a driving method for a source driver of an LCD device according to exemplary embodiments of the present invention, where a pulse is generated on the left side of the frame.
Figure 5C:
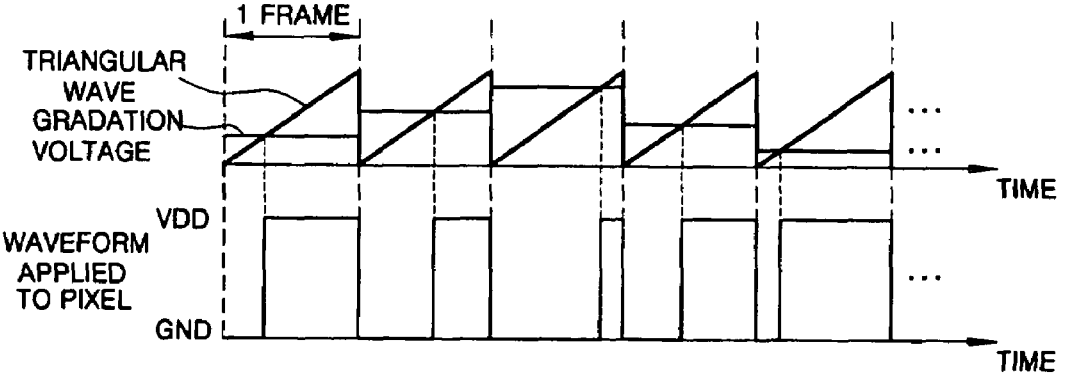
FIG. 5C is a waveform diagram illustrating a driving method for a source driver of an LCD device according to exemplary embodiments of the present invention, where a pulse is generated on the right side of the frame.

FIGS. 5A-5C are waveform diagrams illustrating a driving method for a source driver according to exemplary embodiments of the present invention.

FIGS. 5A-5C illustrate a PWM pulse signal that is applied to one pixel 110 from a source driver 200 per each frame. The comparator 230 compares that gradation voltage, which is an analog signal output by a D/A converter 210, with triangular waves output by a triangular wave generator 220. A driving voltage VDD is output if the triangular waves are higher than the gradation voltage, and a ground voltage GND is output if the triangular waves are lower than the gradation voltage so that data voltages with various pulse widths that may be proportionate can be applied to corresponding pixels. The pulse widths of the PWM pulse waveforms are freely adjustable and capable of displaying various gradations according to the magnitude of the analog voltage or shape of the triangular waves.

Further, the PWM pulse waveform is capable of outputting various PWM pulse signals such as (a) a PWM pulse that is at the center (as illustrated in FIG. 5A), (b) a PWM pulse that is at the left side (as illustrated in FIG. 5B) and (c) a PWM pulse that is at the right side (as illustrated in FIG. 5C) by using various shaped triangular waves outputted from the triangular wave generator 220.

As described above, the source driver 200 of the LCD device according to the exemplary embodiments of the present invention differs from a conventional source driver by using the D/A converter 210, the triangular wave generator 220 and the comparator 230 so that the source driver in one an exemplary embodiment of the present invention enables a fast response speed that is a benefit of an OCB mode device by applying PWM pulses to pixels, thereby solving a problem of slow response speed due to the limitations of slew rate caused by the amp/buffer 22 utilized in the conventional source driver.

Therefore, in an LCD device according to exemplary embodiments of the present invention, a source driver includes the D/A converter, the triangular wave generator and the comparator which enable the LCD device to obtain a fast response speed that is a benefit of an OCB mode by applying PWM pulses to pixels, thereby solving a problem of slow response speed due to the limitations of the slew rate of the amp/buffer utilized in the conventional source driver.

While the invention has been described in connection with certain exemplary embodiments it is to be understood by those skilled in the art that the invention is not limited to the disclosed embodiments, but, on the contrary, is intended to cover various modifications included within the spirit and scope of the appended claims and equivalents thereof.

What is claimed is:

1. A liquid crystal display device comprising:

a liquid crystal display panel comprising a plurality of pixels which are located at a region where a plurality of scan lines and a plurality of data lines cross each other, each pixel comprising a common electrode, a pixel electrode and OCB liquid crystals;

a scan driver for applying scan signals for selecting the plurality of pixels through the plurality of scan lines;

a source driver for applying data voltages to the plurality of pixels through the plurality of data lines;

a backlight part for applying a light source to the liquid crystal display panel;

a backlight controller for applying a backlight voltage to the backlight part; and a timing controller for applying control signals for controlling operation of the scan driver, the source driver and the backlight controller, wherein the source driver comprises a D/A converter for outputting an analog signal corresponding to gradation data input, a triangular wave generator for outputting triangular wave signals, and a comparator for generating the data voltages to be applied to the plurality of pixels without using an amplifier by comparing the analog signal with the triangular wave signals.

2. The liquid crystal display device according to claim 1, wherein the comparator outputs a driving voltage of the comparator if the triangular wave signals are greater than the analog signal.

3. The liquid crystal display device according to claim 2, wherein the comparator outputs a reference voltage of the comparator if the triangular wave signals are less than the analog signal.

4. The liquid crystal display device according to claim 1, wherein the data voltages have a width that is varied according to a level of the analog signal.

5. The liquid crystal display device according to claim 1, wherein the data voltages have a width varied according to a level of the triangular wave signals.

6. The liquid crystal display device according to claim 1, wherein the triangular wave generator comprises a function generator.

7. The liquid crystal display device according to claim 1, wherein the triangular wave generator comprises a square wave generator for producing square waves, and an integrator for integrating the square waves.

8. The liquid crystal display device according to claim 1, further comprising a DC-DC converter for applying a voltage for bend transition of the OCB liquid crystals to the common electrode.

9. The liquid crystal display device according to claim 1, wherein the backlight part comprises a red LED, a green LED and a blue LED for sequentially emitting red, green and blue lights.

10. The liquid crystal display device according to claim 1, wherein the backlight part is a white LED or cold cathode fluorescence lamp (CCFL) for emitting white light.

11. The liquid crystal display device according to claim 10, wherein the liquid crystal display further comprises red, green and blue color filters for filtering light emitted from the backlight part.

12. A liquid crystal display device comprising:

a liquid crystal display panel comprising a plurality of pixels which are located at a region where a plurality of scan lines and a plurality of data lines cross each other, each pixel comprising a common electrode, a pixel electrode and OCB liquid crystals;

a scan driver for applying scan signals for selecting the plurality of pixels through the plurality of scan lines;

a source driver for applying data voltages to the plurality of pixels through the plurality of data lines;

a backlight part for applying a light source to the liquid crystal display panel;

a backlight controller for applying a backlight voltage to the backlight part; and a timing controller for applying control signals for controlling operation of the scan driver, the source driver and the backlight controller, wherein the source driver comprises a D/A converter for outputting an analog signal corresponding to gradation data input, a triangular wave generator for outputting triangular wave signals, and a comparator for generating the data voltages to be applied to the plurality of pixels without using an amplifier by comparing the analog signal with the triangular wave signals, and wherein each of the plurality of pixels further comprises a switching transistor for transmitting a corresponding one of the data voltages transmitted through the data lines to the pixel electrode in response to a corresponding one of the scan signals; and a storage capacitor for storing an electric charge corresponding to a voltage difference between the corresponding one of the data voltages and a common voltage of the common electrodes.

* * * * *